United States Patent [19]

Chung

[11] Patent Number: 4,747,422

[45] Date of Patent: May 31, 1988

[54] PNEUMATIC UMBRELLA

[76] Inventor: Ching-Horng Chung, No. 31, Wu Fu Street, Mei Nung Jenn, Kaohsiung Hsien, Taiwan

[21] Appl. No.: 46,801

[22] Filed: May 7, 1987

[51] Int. Cl.[4] ..... A45B 25/14

[52] U.S. Cl. ..... 135/20 M

[58] Field of Search ..... 135/20 M, 20 B, 20 R

[56] References Cited

U.S. PATENT DOCUMENTS

| | | | |
|---|---|---|---|
| 321,722 | 7/1885 | Herron | 135/20 M |
| 1,411,560 | 4/1922 | Beaty | 135/20 B |
| 2,172,549 | 9/1939 | Solomon | 135/20 B |
| 3,213,868 | 10/1965 | Forbes | 135/20 M |

FOREIGN PATENT DOCUMENTS

| | | | |
|---|---|---|---|
| 1419267 | 10/1965 | France | 135/20 B |
| 248176 | 7/1969 | U.S.S.R. | 135/20 B |

*Primary Examiner*—J. Karl Bell

*Attorney, Agent, or Firm*—Varndell Legal Group

[57] ABSTRACT

This invention relates to a pneumatic umbrella especially one of which the plunger in the middle section of the barrel will force the air to flow from the lower chamber to the upper chamber through the throttle valve and cause the piston in the upper section to push the sliding hub up to unfold the umbrella when the lower section is pushed up by the hand. When the operating button is depressed, the plunge will be pulled down by the spring and the piston will be sucked down with the sliding hub to fold the umbrella. When the knob set in the bottom cap is turned to some degree and the air release button at the bottom of the knob is depressed, the barrel can be collapsed one section inside another for easy carrying.

5 Claims, 4 Drawing Sheets

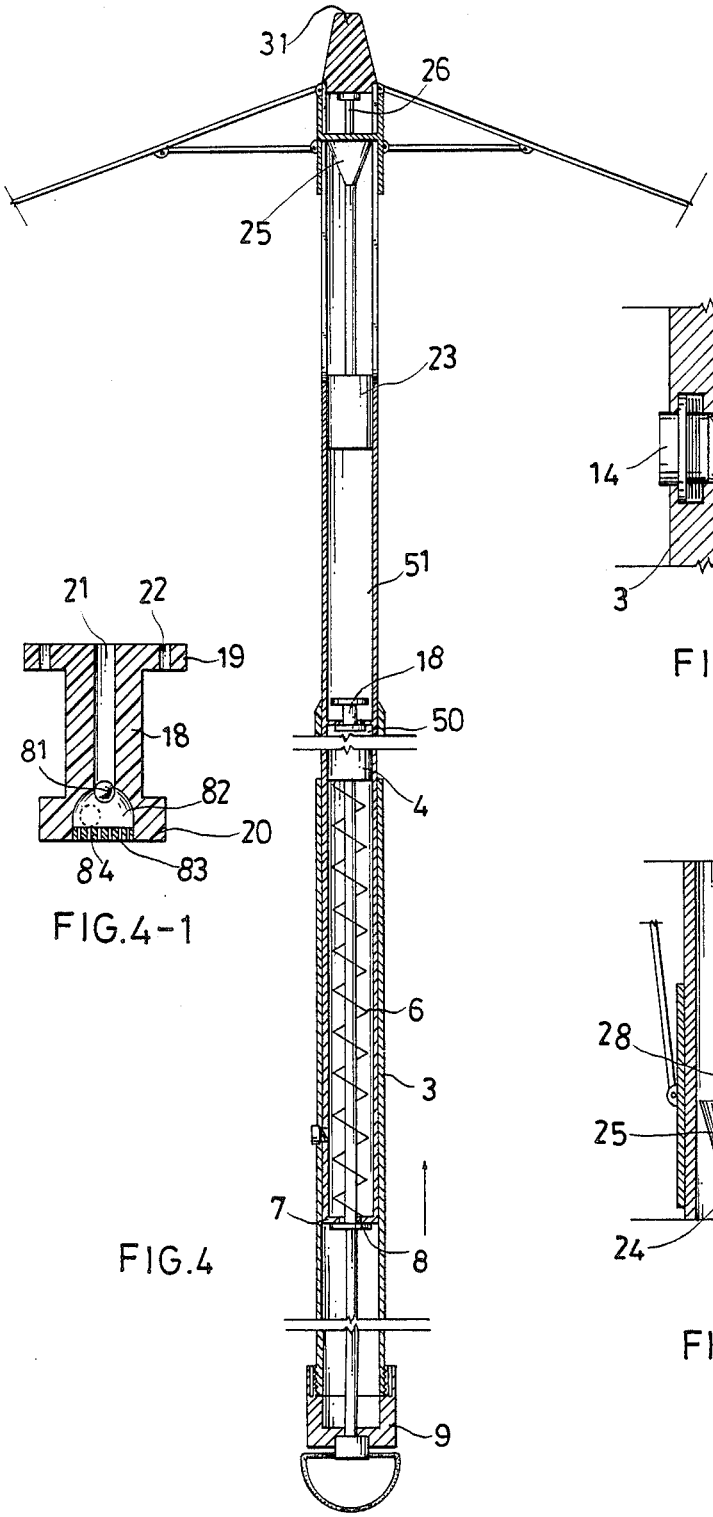
FIG.4
FIG.4-1
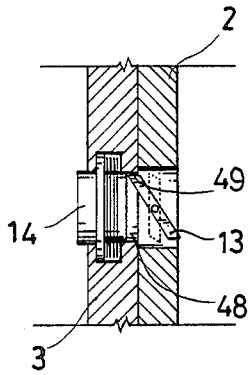
FIG.5
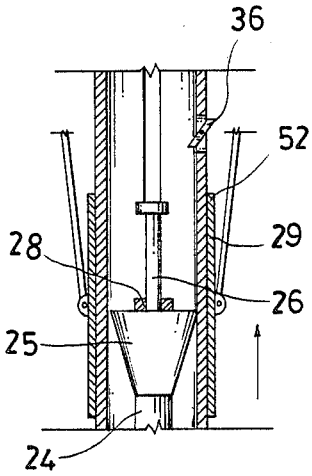
FIG.6

II – II

PNEUMATIC UMBRELLA

BACKGROUND AND SUMMARY OF THE INVENTION

Umbrellas are used all the year round and are indispensable to every household but disadvantages still exist in the conventional umbrellas which can be classified into the two following kinds:

1. Manual umbrellas: This kind of umbrellas making use of springs and snap catches is folded and unfolded by two hands. It is often the case that the user's fingers are injured by the snap catch. It is not only difficult but also more dangerous for children to use.

2. Automatic umbrellas: This kind of umbrellas also makes use of springs and snap catches but has a release button. The umbrella will be unfolded automatically when the release button is depressed. But the sudden unfolding often tends to make a noise and cause damage to the umbrella. The odds are that it injures the bystanders when being unfolded. Furthermore, it also needs two hands to fold the umbrella.

Since both kinds of umbrellas make use of springs, the natural elastic fatigue will result in failure of the umbrella. In view of these disadvantages, the inventor worked hard to make improvement and developed this invention.

So the main object of this invention is to provide a pneumatic umbrella which comprises a barrel in three sections, a piston fitted in the barrel and connected to a sliding hub, and a cone, that work together to unfold or fold the umbrella so that the umbrella can be operated by one hand.

Another object of this invention is to provide a pneumatic umbrella which has a throttle valve installed at the bottom of the middle section of the barrel to control the air flow between the upper and lower compressing chambers.

Still another object of this invention is to provide a pneumatic umbrella which has a plunger connected with a rod to the knob at the bottom cap of the barrel and having an air passage through the rod and knob for releasing the air when the air release button at the knob is depressed to collapse the barrel one section inside another.

Still another object of this invention is to provide a pneumatic umbrella of which the plunger rod has an oblong plate pushed against the bottom of the middle section, which has a corresponding oblong hole, by a tension spring fitted over the rod between the plunger and the oblong plate so that the spring can provide a force of return when the lower section of the barrel moves up to compress the air in the lower compressing chamber.

BRIEF DESCRIPTION OF THE DRAWINGS

FIG. 4 is a longitudinal section of the said umbrella when it is unfolded.

FIG. 4-1 is a vertical section of the throttle valve of the said umbrella.

FIG. 5 illustrates the said operating button when the said umbrella is unfolded.

FIG. 6 is a vertical section of the cone and the cross rod of the sliding hub of the said umbrella when it is unfolded.

FIG. 7-1 is a cross section by the I—I line as shown in FIG. 7.

FIG. 9-1 is a bottom view of the air release button as shown in FIG. 9.

DETAILED DESCRIPTION OF THE PREFERRED EMBODIMENT

Figure 1:
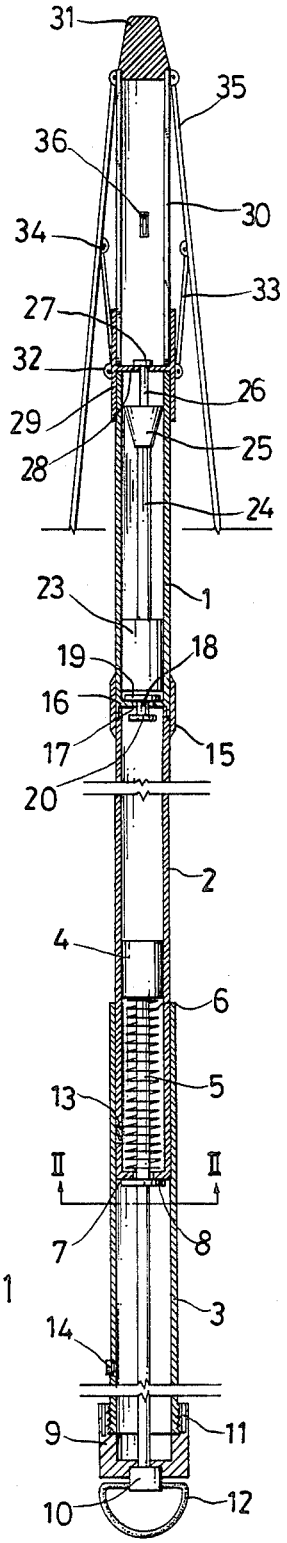
FIG. 1 is a longitudinal section of the pneumatic umbrella of this invention when it is folded.

As shown in FIG. 1 the barrel of the pneumatic umbrella of this invention comprises an upper section 1, middle section 2 and lower section 3. Fitted in the middle section is a plunger 4 which has a rod 5 screwed on the bottom. The rod 5 extends downward through the bottom 7 of the middle section 2 and has an oblong plate 8 against the bottom 7. A tension spring 6 is fitted over the rod 5 between the plunger 4 and the oblong plate 8. The rod 5 further extends all way down the lower section 3, which is telescopically fitted on the middle section 2, and is fixed by threads to the knob 10 on the bottom cap 9 of the lower section 3. The bottom cap 9 has a circular groove 11 for holding the ribs after the umbrella is folded, and a ring 12. A snap catch 13 is provided in the wall of the middle section 2 near the bottom 7 and an operating button 14 is provided in the wall of the lower section 3. The upper section 1 and middle section 2 are joined together by screw threads. A reinforcing sleeve 15 is fitted over the joint. The bottom 16 of the upper section 1 has a hole 17 for a throttle valve 18 to fit in such way that the bottom 16 is in between the upper and lower discs 19, 20. A piston 23 is fitted in the upper section 1 above the upper disc 19. A rod 24 extends from the piston 23 and is connected to the apex of a cone 25. A rod 26 with a head 27 extends from the base of the cone 25 and is fitted in the hole in a cross bar 28 with both ends extending through the longitudinal guide slots 30 in both sides of the upper section and fixed to the sliding hub 29. A cap 31 is fitted on the top end of the upper section 1. The hub 29 has a ring projection 32 for the ends of the prop ribs 33 to fit. The other ends of the prop ribs 33 are hinged to the main ribs 35 which are radially connected to the fixed hub on the top end of the upper section 1. A snap catch 36 is provided in the wall of the upper section 1 near the top end.

Figure 2:
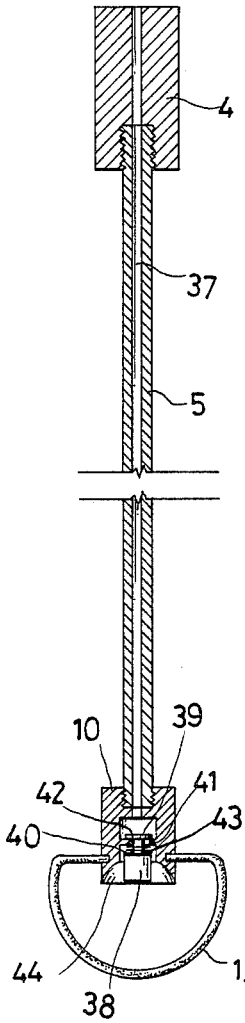
FIG. 2 is a longitudinal section of the assembly of plunger, rod and handle of the said umbrella.

As shown in FIG. 2, the plunger 4, rod 5 and knob 10 are connected by means of threads and have an air passage 37 in the center. The knob 10 has an air release button 38 fitted in the outlet formed by the inner circular projection 41. A spring 43 is fitted over the neck of the air release button 38 so that the shoulder 39 of the button is pulled by the spring 43 to keep contact with the inner circular projection 41 and to close the outlet 42. The head of the air release button 38 is set in the counter sink 44 at the bottom of the knob 10.

Figure 3:
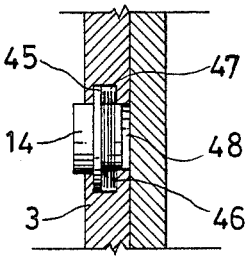
FIG. 3 illustrates the operating button of the said umbrella when it is folded.

The operating button as shown in FIG. 3 has a circular projection 45 in the middle and a spring 46 fitted over the right part so as to form a catching-releasing-room 48 after it is fitted in the T recess 47 in the wall of the lower section 3.

The throttle valve 18 in FIG. 4-1 has air compensating orifices 22 in the upper disc 19 and an air passage 21 in the center leading to the vaulted chamber 82 at the bottom. A ball 81 is provided in the vaulted chamber 82 and a cover 84 is used to cover the vaulted chamber 82. The cover 84 has a plurality of ports 83 for the air to pass.

To unfold the umbrella, one can only hold the lower section 3 and push it with the cap 31 against the ground. With the force applied, the lower section 3 will move upward and with the oblong plate 8 engaging with the bottom 7 of the middle section 2, and with the tension spring 6 being stretched, the plunger 4 moves upward as shown in FIG. 4. At this time, the operating button 14 in the wall of the lower section 3 moves up for the snap catch 13 in the wall of the middle section 2 to snap in the catching-releasing room 48 and engage with the room wall 49 as shown in FIG. 5 to stop the lower section 3 from sliding down and to prevent the compressed air in the lower section 3 from being released. As shown in FIGS. 4 and 4-1, the body of the throttle valve 18 is pushed up when the plunger 4 moves upward and the ball 81 in the vaulted chamber 82 closes the air passage 21 prohibiting the compressed air in the lower chamber 50 from flowing into the upper chamber 51 of the upper section 1. But when the umbrella is held vertical with the top cap 31 leaving the ground and standing upward, the ball 81 will leave the air passage 21 as shown in FIG. 4-1 and allow the air in the lower chamber 50 to pass through the air ports 83 and air passage 21 into the upper chamber 51 and to push the piston 23 up.

As shown in FIG. 6, when the piston 23 moves up, the cone 25, which is connected to the piston 23 with a rod 24, and the connecting rod 26 also move up and push up the sliding hub 29 which is connected with the connecting rod 26 by means of a cross bar 28. Since the snap catch 36 in the wall of the upper section 1 is pushed flat by the top rim 52 of the sliding hub 29 before the cone 25 arrives, the cone 25 is not stopped by the snap catch 36 when it moves up.

Figure 7:
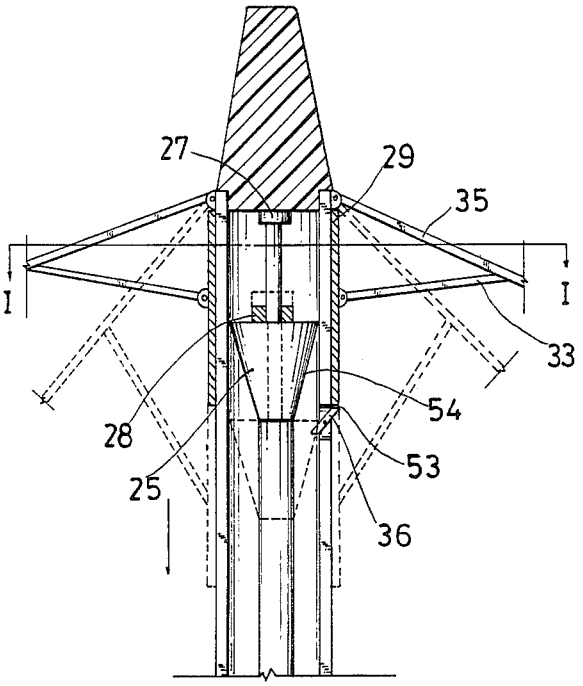
FIG. 7 illusbrates the movement of the said cone when the said umbrella is being unfolded.

As shown in FIGS. 7 and 7-1, the prop ribs 33 hinged to the sliding hub 29 move up with the sliding hub 29 and prop the main ribs 35 open. At this time, the sliding hub 29 is stopped at the bottom rim 53 by the snap catch 36 from sliding down.

To fold the umbrella, the operating button 14 as shown in FIG. 5 is depressed to push the snap catch 13 away from the catching-releasing-room 48 and to release the lower section 3. As shown in FIG. 4, the tension spring 6 can pull the plunger 4 down when the lower section 3 moves down. At this moment, the throttle valve 18 is sucked down and open, and the air flows from the upper chamber 51 to the lower chamber 50 through the air compensating orifices 22 and the air passage 21. As shown in FIG. 7, the cone 25 slides down with the piston 23 and pushes the snap catch 36 flat. As a result, the sliding hub 29 is released and slides down with the prop ribs 33 to fold the umbrella slowly.

Figure 8:
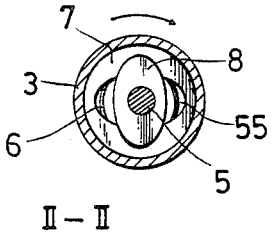
FIG. 8 is a cross section by the II—II line as shown in FIG. 1.
Figures 1, 7:
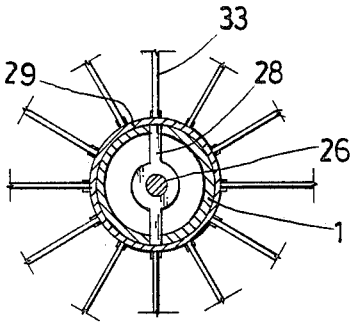
Figure 9:
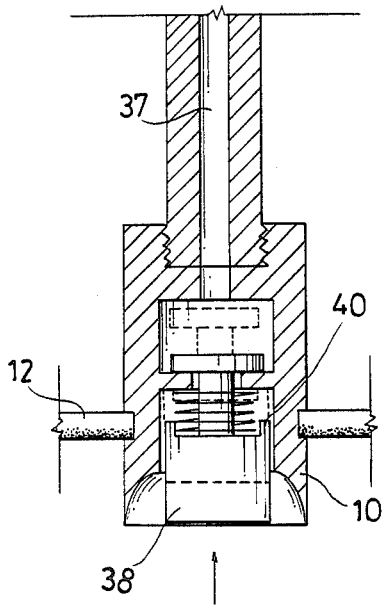
FIG. 9 is a bottom view of the air release button as of the said umbrella.
Figures 1, 9:
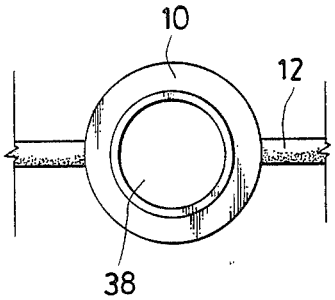
Figure 10:
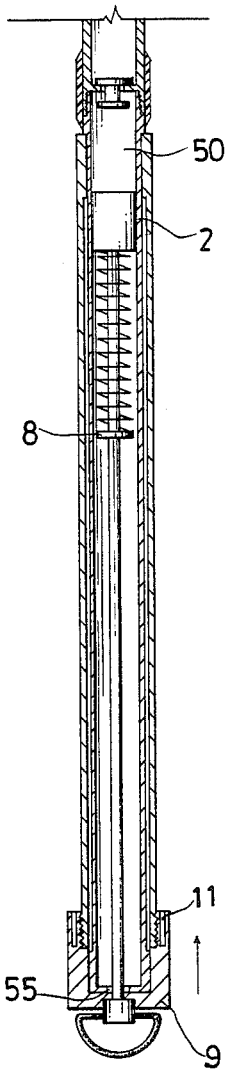
FIG. 10 illustrates the barrel of the said umbrella with the middle section inside the lower section.

As shown in FIG. 8, the oblong plate 8 is connected to the plunger 4 and pushed by the spring 6 against the bottom 7 of the middle section 2 which has an oblong hole corresponding to the oblong, plate 8.

To collapse the barrel as shown in FIGS. 9, 9-1, 10, 1, and 8, the ring 12 is turned to some degree to make the oblong plate in alignment with the oblong hole 55, the oblong plate 8 will go into the middle section 2. Then the air release button 38 is depressed to allow the air in the lower chamber 50 to come out through the air passage 37. After the barrel is collapsed one section inside another, the ends of the main ribs 35 can be packed in the circular groove 11 of the bottom cap 9.

I claim:

1. A pneumatic umbrella mainly comprising a barrel consisting of an upper section, middle section and lower section; said upper section having a snap catch in the wall, a guide slot in each side of the wall, a cap with a fixed hub for main ribs at the top, and a sliding hub filled over the upper section for prop ribs hinged to the main ribs and having a cross bar to slide in the guide slots and for connecting a rod; said connecting rod with a head at the top extending downward and connected to a cone; said cone having a rod connected to a piston; said middle section being connected with the upper section by means of threads and strengthened at the joint with a reinforcing sleeve, having a hole in the bottom for a throttle valve to fit, and an assembly of plunger, rod and tension spring; said tension spring being fitted over the plunger rod between the bottom of the middle section and an oblong plate on the rod; said plunger rod extending into the lower section, through the bottom cap screwed on the lower section, and fixed to a knob having a ring; said lower section and middle section also having an operating button and snap catch for the pneumatic umbrella to unfold or fold slowly.

2. A pneumatic umbrella according to claim 1 wherein the connected to the cross bar of the sliding hub with a round-headed rod is made in such way that it can push flat the snap catch in the wall of the upper section and release the sliding hub.

3. A pneumatic umbrella according to claim 1 wherein the throttle valve has an air passage in the center, air compensating orifices in the top disc, a vaulted chamber at the bottom disc, a perforated cover covering the chamber, and a ball to close the air passage as the umbrella is held upside down.

4. A pneumatic umbrella according to claim 1 wherein the bottom of the middle section has an oblong hole corresponding to the oblong plate so that the oblong plate can go through the oblong hole to allow the barrel to collapse one section inside another.

5. A pneumatic umbrella according to claim 1 wherein the plunger, rod and knob are connected by means of threads and have an air passage in the center for releasing the air when the air release button set in the counter sink at the knob is depressed for the purpose to collapse the umbrella.

* * * * *